US011346124B2

(12) United States Patent
Hiner et al.

(10) Patent No.: US 11,346,124 B2
(45) Date of Patent: May 31, 2022

(54) FENCE CORNER SUPPORT

(71) Applicant: Lock Jawz LLC, Georgetown, IN (US)

(72) Inventors: Nicholas Andrew Hiner, Georgetown, IN (US); Alan Wade Simon, Portland, TN (US)

(73) Assignee: LOCK JAWZ LLC, Georgetown, IN (US)

( * ) Notice: Subject to any disclaimer, the term of this patent is extended or adjusted under 35 U.S.C. 154(b) by 659 days.

(21) Appl. No.: 16/176,717

(22) Filed: Oct. 31, 2018

(65) Prior Publication Data

US 2019/0128014 A1 May 2, 2019

Related U.S. Application Data

(60) Provisional application No. 62/580,216, filed on Nov. 1, 2017.

(51) Int. Cl.

| | |
|---|---|
| ***E04H 17/08*** | (2006.01) |
| ***E04H 17/22*** | (2006.01) |
| ***E04H 17/10*** | (2006.01) |
| ***E04H 17/00*** | (2006.01) |

(52) U.S. Cl.

CPC ..... *E04H 17/08* (2013.01); *E04H 17/22* (2013.01); *E04H 17/006* (2021.01); *E04H 17/10* (2013.01)

(58) Field of Classification Search

CPC ..... E04H 17/08; E04H 17/22; E04H 17/006; E04H 17/10

USPC ..... 52/720.2, 736.1, 169.9, 302.5, 701, 704, 52/706

See application file for complete search history.

(56) References Cited

U.S. PATENT DOCUMENTS

| | | | | | |
|---|---|---|---|---|---|
| 387,413 | A * | 8/1888 | Griffin | E04H 17/08 | 52/151 |
| 942,592 | A * | 12/1909 | Schneider | E04H 17/22 | 52/150 |
| 1,161,865 | A * | 11/1915 | Jones | E04H 17/22 | 52/150 |
| 1,221,481 | A * | 4/1917 | Selway | E04H 17/22 | 52/150 |
| 3,347,572 | A * | 10/1967 | Pfaff, Jr. | E04H 12/24 | 403/27 |
| 4,150,907 | A * | 4/1979 | Thurnauer | F16B 7/04 | 403/234 |
| 4,479,636 | A * | 10/1984 | King | E04H 17/08 | 256/22 |
| 4,763,879 | A * | 8/1988 | Wasicek | E04H 17/08 | 256/36 |

(Continued)

*Primary Examiner* — Basil S Katcheves
*Assistant Examiner* — Omar F Hijaz
(74) *Attorney, Agent, or Firm* — Scott Houtteman; Houtteman Law LLC

(57) ABSTRACT

The corner fence post support consists of cylindrically shaped main ratchet that sits on top of a corner fence post, typically a T-post. A second component, a ratchet socket is attached to support legs. The bottom of the legs can be fitted with specialized foot structures or simply driven into the ground. The legs are usually placed inside the fence line where they provide outward support to the corner post to counter the inward force of the fence line. The main ratchet and ratchet socket can easily engage and lock together at multiple vertical positions, so that the optimal fit can be readily obtained under a variety of local conditions and a variety of grades, whether level, uphill or down-hill.

11 Claims, 5 Drawing Sheets

(56) References Cited

U.S. PATENT DOCUMENTS 4,979,724 A * 12/1990 Williams ..... E04H 17/08
256/36
5,356,101 A * 10/1994 Malloy ..... E04H 12/2215
248/156
6,807,710 B2 * 10/2004 Abbott ..... E05D 3/12
16/221
7,028,991 B2 * 4/2006 Egan ..... E04H 17/20
256/1

* cited by examiner

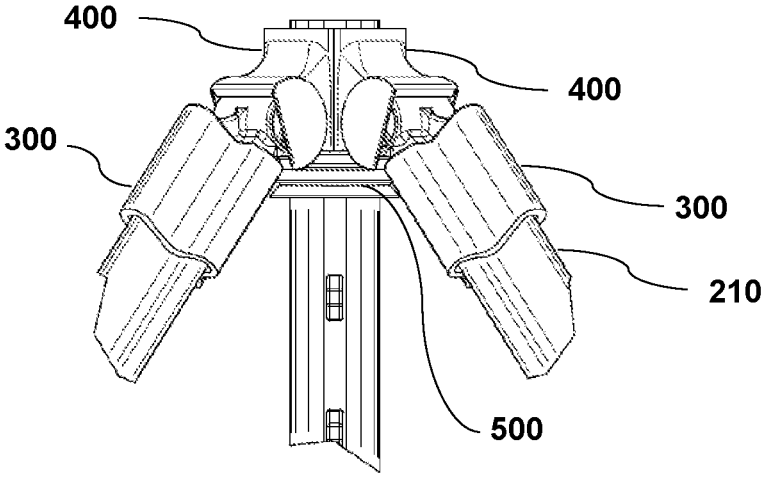
FIG 2
FIG 4
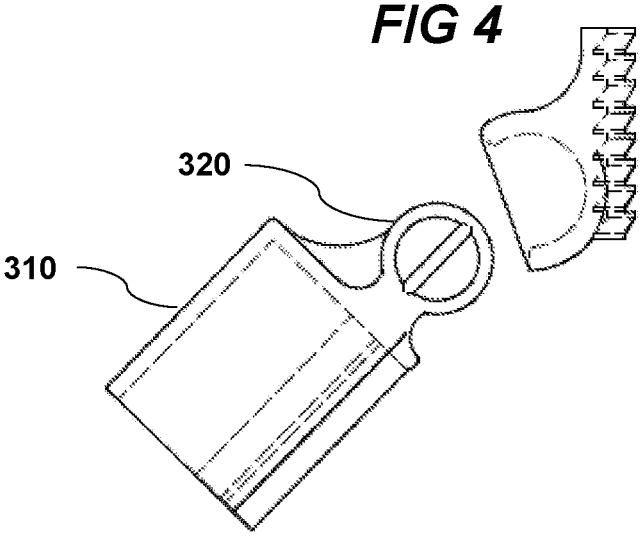
FIG 3
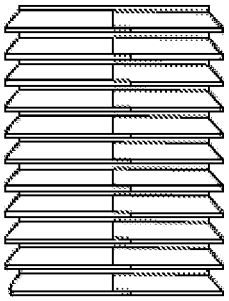
FIG 5

FENCE CORNER SUPPORT

BACKGROUND

The present invention relates to a support for fence posts, particularly T-post fence corner supports. Typically, when a fence post needs support, there is no choice but to use a wooden or other durable post with a cement plug, that is, drill a wide post hole, place the fence post in the middle and fill the hole with cement. Additional posts along with horizontal bracing that extend into the direction in which the fence post needs support is commonly used. These materials are costly and require additional time to install.

Other fence post corner supports are less permanent. In a common configuration, fence post support systems contain two angled support posts that prop up the fence post. The support posts typically engage the fence post near the top and extend into the direction for which the fence post needs support. The support posts typically angle downward and contact the ground or mount to the base of the next post in the fence row. These corner supports suffer certain disadvantages. In particular, these prior art supports have certain connectors mounted on the fence post that fail to properly engage the support posts. When the support posts are installed so that they contact the ground, the ends of the support post contact the fence post connectors at a skewed angle that suggests a relatively mild force will cause the support posts to fail. The supports are also time consuming to construct and have little or no mechanism by which one can make fine adjustments after installation.

SUMMARY

The current system has and improved cylinder and socket joint at the fence post as well as specialized structures at the foot which greatly increase the stability of the support system and are much easier to install. The current invention also features fence post connectors that "ratchet" up and down, thus raising and lowering the height of the point in which the support posts engage the fence post. This ratchet mechanism allows one to marginally increase or decrease the angle of the support posts and thus adjust the supports as needed to tighten and optimize the system to provide maximum support possible for the specific geometry of the fence post needing support.

BRIEF DESCRIPTION OF THE DRAWINGS

FIG. 2 is a close up perspective view of the ratchet mount assembly mounted on top of a corner post of a T-post fence.

FIG. 3 illustrates a barrel mount.

FIG. 4 illustrates a side view of a ratchet socket.

FIG. 5 illustrates the main ratchet.

DETAILED DESCRIPTION

Figure 1:
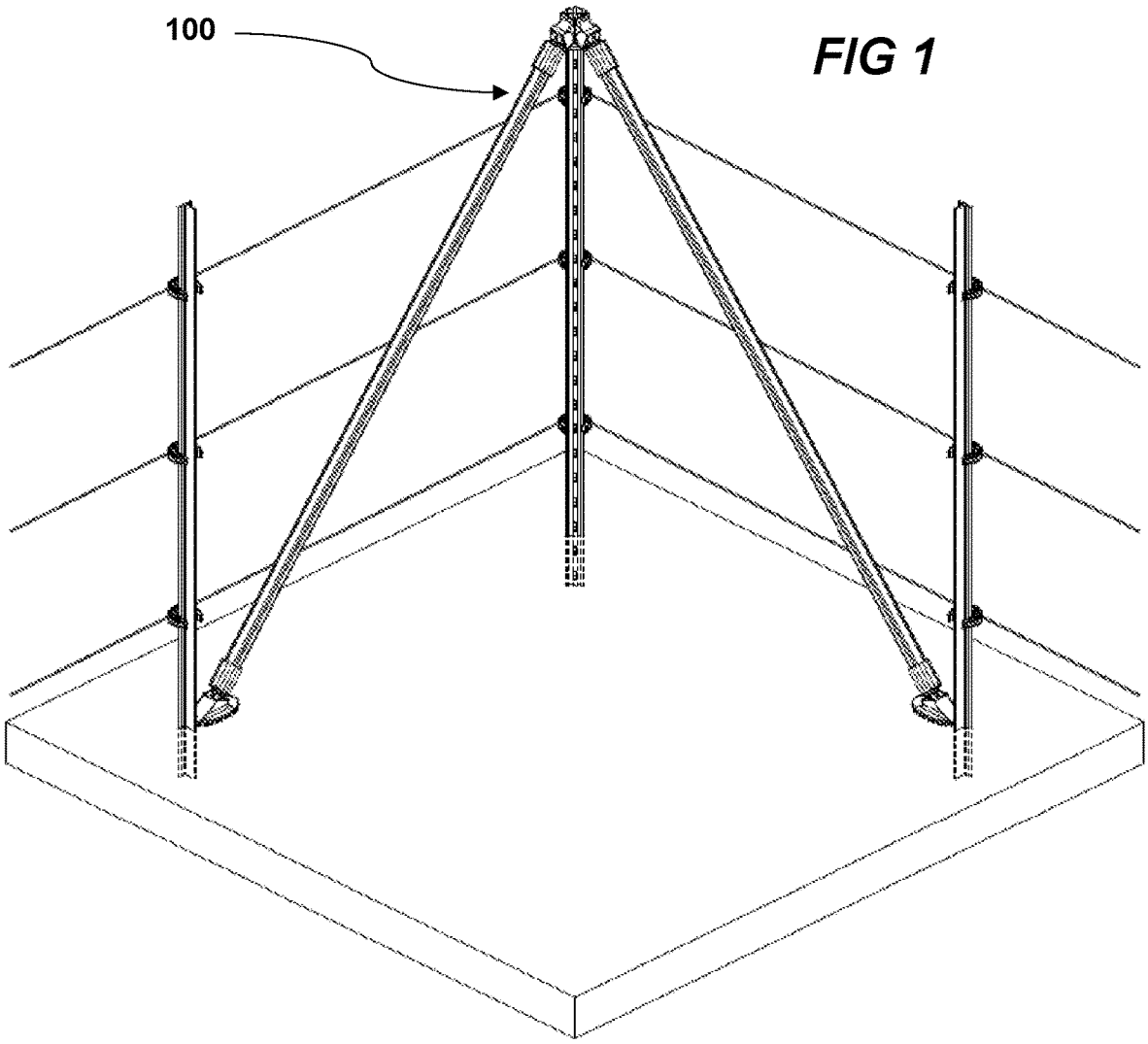
FIG. 1 is a perspective view of the corner support installed on a T-post fence corner.

In a preferred embodiment, the device will support the corner of a T-post fence line. This is illustrated FIG. 1. As shown in FIG. 2, installed at the top of the corner T-post is a cylindrically shaped main ratchet 500 which engages a rachet socket 400 and a barrel mount 300 which is attached to the device legs 210.

Thus, the ratchet mount is made up of three basic parts, the barrel mount, the rachet socket and the main ratchet, illustrated in exploded view over FIGS. 3-5. The barrel mount left side 310, as illustrated in FIG. 3, is designed to fit over a support leg. Typically, the support leg is the same T-post that makes up the fence line. The right side of the barrel mount 320 is cylindrically shaped and designed to fit in, and pivot with, the cylindrically shaped socket of the ratchet socket, see FIG. 4.

Figure 6A:
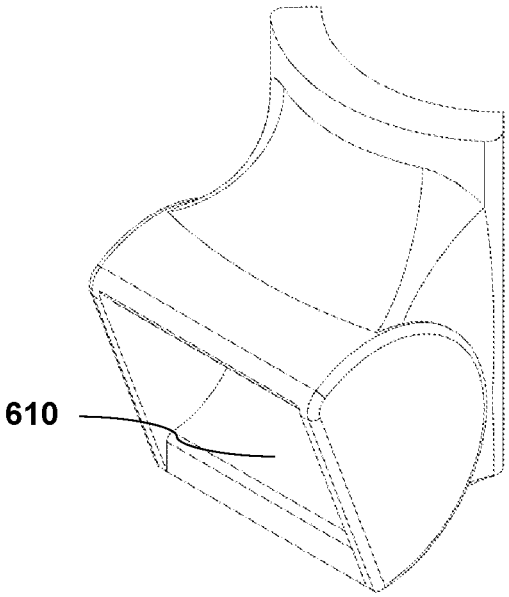
FIG. 6A is a close up perspective view of the ratchet socket of FIG. 4 showing the cylindrical shaped socket.
Figure 6B:
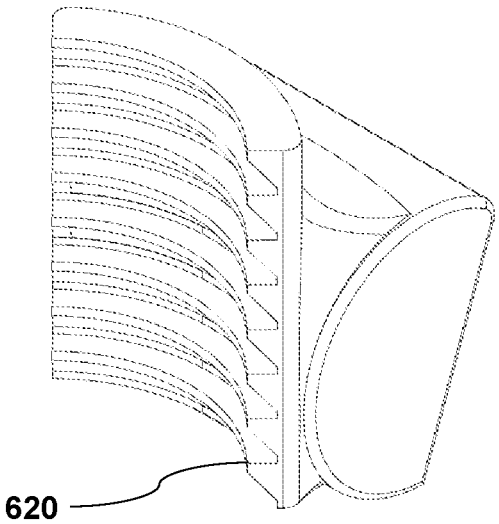
FIG. 6B is close up perspective view of the ratchet socket of FIG. 4 showing the concave outer surface complementary to the main ratchet outer surface.

The ratchet socket can be seen in more detail in FIGS. 6A and 6B. FIG. 6A shows the socket 610 into which fits the cylindrically shaped end of the barrel mount 320, 810. These cylindrically shaped sockets are preferred, because they provide lateral stability. But any conventional connection, such as a "ball and socket" combination, can be used in circumstances were a greater range of motion and less lateral stability is desired.

The other side of the ratchet socket is illustrated in FIG. 6B showing a concave outer surface containing multiple ridges 620. This surface is specifically designed to engage with the complementary convex outer surface of the main ratchet 720 and in multiple vertical positions. Other geometric shapes for the ridges will also function. A smaller ridge, for example, could be used to offer a finer adjustment per step where as a larger ridge would increase overall strength.

Thus, when assembling the corner support system, the user can "ratchet" vertically up or down the ratchet socket relative to the main ratchet depending on the users needs. If there is too much slack in the system, the user can "ratchet" the socket down one or more ridges and thus tighten the fit between the corner post and the support leg(s). If, on the other hand, the user needs to place the foot of support leg(s) closer to the corner post, the user can "ratchet" the ratchet socket up relative to the main ratchet. This will provide additional slack and allow the user to move the foot of the support leg(s) closer Alternatively, the user can reposition the main ratchet further down the post providing additional adjustment capability.

Figure 7:
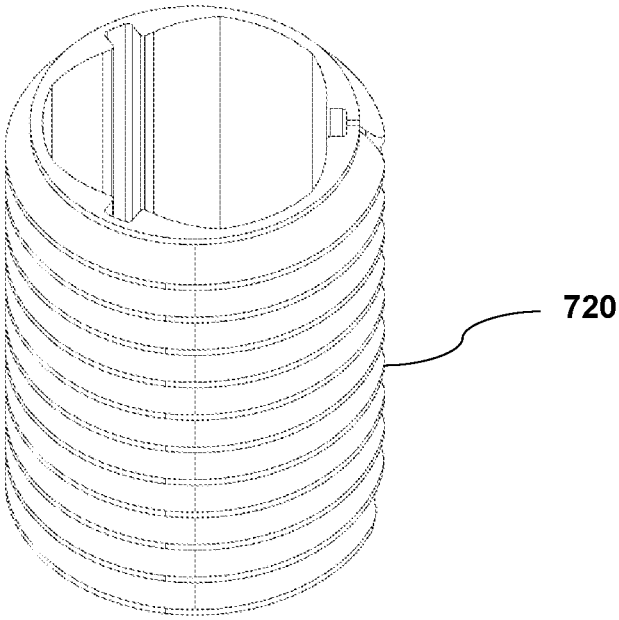
FIG. 7 is a close up perspective view of the main ratchet.

FIG. 7 is a close up perspective view of the main ratchet. Preferably, it is generally cylindrically shaped and has an inner surface designed to snugly engage the top of the corner post. Other geometric shapes will also function. A cylindrical shape, however, is preferred because it offers a greater range of use. The support legs can be deployed at any angle. Note, the inventor has found that a preferable deployment is to place two support legs each flush with the two lines of fence extending out from the corner. This deployment is illustrated in FIG. 1.

The fence support will function perfectly well if the legs are driven into the ground. In this case there is no need for any foot mount assembly. The inventor has found, however, that the foot mount assembly to be preferred in many circumstances because the foot mounts are reliably stable and easier to install than driving the legs into the ground and can be more readily adjusted.

Figure 8A:
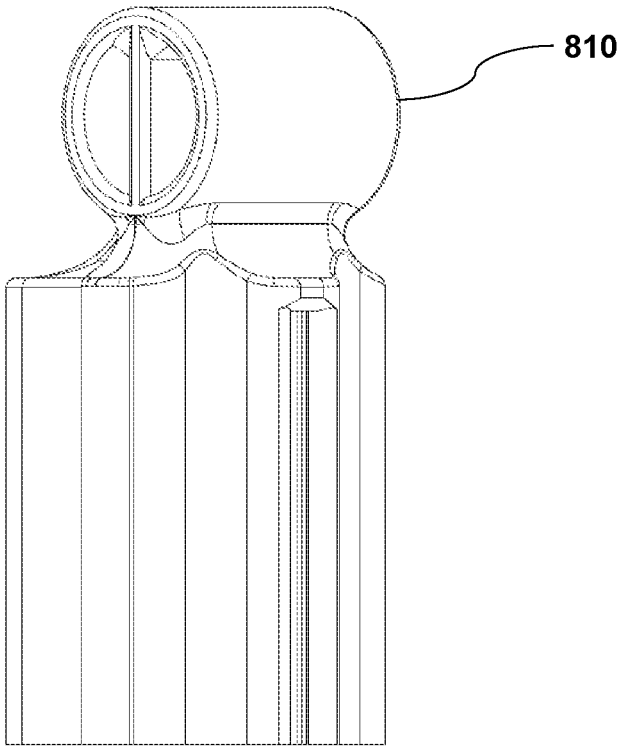
FIG. 8A is close up perspective view of the top of the barrel mount of FIG. 3 showing the cylindrical barrel designed to fit into a cylindrical socket.
Figure 8B:
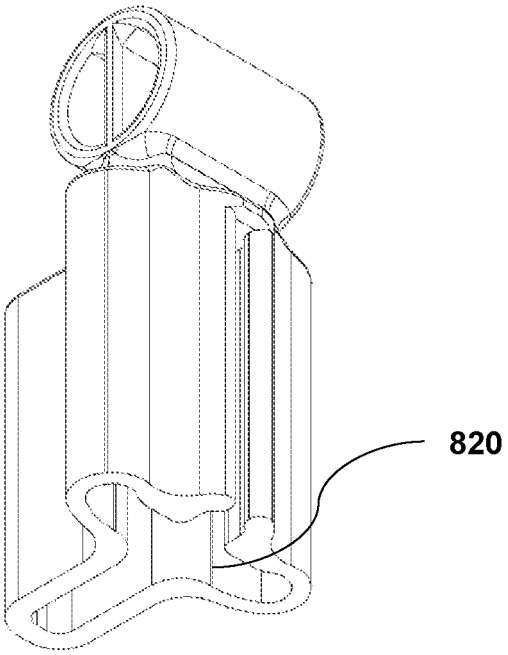
FIG. 8B is a close up perspective view of the bottom of the barrel mount of FIG. 3 designed to fit over the end of a T-post.
Figure 8C:
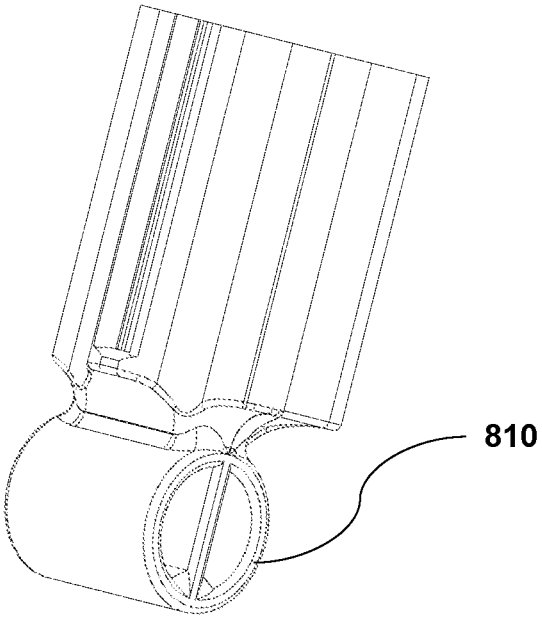
FIG. 8C is a close up perspective of an inverted barrel mount showing that the cylindrical barrel is also designed to fit into a socket of the foot mount.
Figure 9:
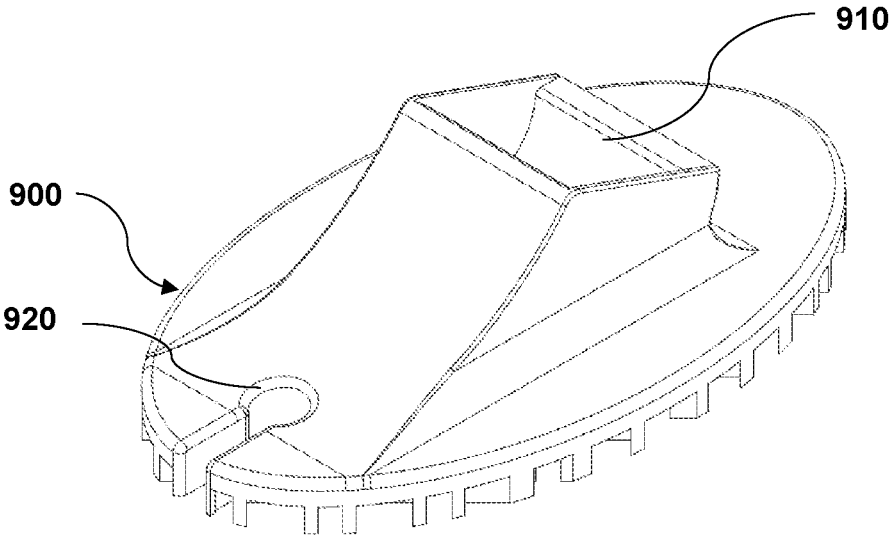
FIG. 9 is a close up of the foot mount.

The foot mount assembly is shown in FIGS. 8C and 9. FIG. 8C illustrates one component of the foot mount, the connector. Note, in this preferred embodiment the connector is identical with the barrel mount. The connector has a cylindrical portion 810 that engages with, and pivots on, the socket 910 of the foot mount.

The foot mount assembly will operate acceptably without additional components. However, for extra stability a key hole 920 is present through which the user can drive a stake. The foot can also be braced, for example, by driving a stake or a T-post into the ground at the perimeter of the ground "foot" socket for additional insurance against slipping as illustrated in FIG. 1.

What is claimed is:

1. A fence post support comprising: a ratchet mount assembly and leg members said ratchet mount assembly further comprising a generally cylindrically shaped main ratchet, a ratchet socket and a barrel mount;

said main ratchet configured to fit over a fence post and having an outer surface configured to interlock with a complementary outer surface on the ratchet socket so that the ratchet socket can engage the main ratchet at multiple vertical positions;

said ratchet socket having a first end with said complementary outer surface and a second end configured to engage with the barrel mount;

said barrel mount having a first end configured to engage with the ratchet socket and a second end configured to fit over a leg member upper end, and said fence post further comprising foot mount assemblies, each of said foot mount assemblies comprise a connector and foot mount;

said connector having a first end configured to fit over a leg member lower end and a second end configured to engage the foot mount;

said foot mount having a first end configured to engage the connector and a second end configured to sit on the ground, wherein said main ratchet outer surface is convex with a plurality of mutually parallel grooves and said ratchet socket complementary outer surface is concave with a plurality of mutually parallel grooves.

2. The fence post support as defined in claim 1 wherein the engagement between the ratchet socket and the barrel mount allows the barrel mount to pivot relative to the ratchet socket.

3. The fence post support as defined in claim 1 wherein the engagement between the connector and the foot mount allows the foot mount to pivot relative to the connector.

4. The fence post support as defined in claim 1 wherein said plurality of grooves on the main ratchet consists of 2 to 40 grooves and said plurality of grooves on the ratchet socket consists of 2 to 30 grooves.

5. The fence post support as defined in claim 1 wherein said plurality of grooves on the main ratchet consists of 11 to 15 grooves and said plurality of grooves on the ratchet socket consists of 6 to 10.

6. The fence post support as defined in claim 1 further comprising:

said ratchet mount assembly consists of a main ratchet, two ratchet sockets and two barrel mounts;

said leg members consists of two leg members; and said foot mount assemblies consist of two foot mount assemblies.

7. The fence post support as defined in claim 1 further comprising: said leg members are T-posts.

8. The fence post support as defined in claim 1 further comprising said fence post is a corner post.

9. A method of corner fence post support comprising:

a ratchet mount assembly, two leg members and two foot mount assemblies, said ratchet mount assembly further comprising a generally cylindrically shaped main ratchet, two ratchet sockets and two barrel mounts;

said main ratchet configured to fit over a corner fence post and having a non-planer outer surface configured to interlock with a complementary non-planer surface on the two ratchet sockets so that the ratchet sockets can engage the main ratchet at multiple vertical positions;

said ratchet sockets having first ends with said complementary non-planer surfaces and second ends configured to engage with the barrel mounts;

said barrel mounts having first ends configured to engage with the ratchet sockets and second ends configured to fit over the leg member upper ends;

said two foot mount assemblies each further comprising a connector and a foot mount;

said connector having a first end configured to fit over the leg member lower end and a second end configured to engage the foot mount;

said foot mount having a first end configured to engage the connector and a second end configured to sit on the ground;

wherein said leg members prop up the corner post by their positioning angled down into the ground to the inside of the fenced in area and thus support the corner post against inward pull of the fencing; and wherein said main ratchet non-planar outer surface is convex with a plurality of mutually parallel grooves and said complimentary non-planar surface on the two ratchet sockets is concave with a plurality of mutually parallel grooves.

10. The method of corner fence post support as defined in claim 9 further comprising:

said two leg members are each positioned against the two fence line inner surfaces that extend out from the fence corner.

11. The method of corner fence post support as defined in claim 9 further comprising: said fence is a T-post fence.

* * * * *